US010655328B2

(12) United States Patent
Harik et al.

(10) Patent No.: US 10,655,328 B2
(45) Date of Patent: May 19, 2020

(54) STRUCTURAL REINFORCEMENT, REINFORCED STRUCTURAL MEMBER AND RELATED METHOD

(71) Applicant: The University of Kentucky Research Foundation, Lexington, KY (US)

(72) Inventors: Issam Elias Harik, Lexington, KY (US); Nisal Abheetha Peiris, Lexington, KY (US); Drew Christian Thompson, Frankfort, KY (US); David Cambron Murray, Upton, KY (US); Clayten Nicholas Greenwell, Lexington, KY (US)

(73) Assignee: THE UNIVERSITY OF KENTUCKY RESEARCH FOUNDATION, Lexington, KY (US)

( * ) Notice: Subject to any disclaimer, the term of this patent is extended or adjusted under 35 U.S.C. 154(b) by 1579 days.

(21) Appl. No.: 13/901,668

(22) Filed: May 24, 2013

(65) Prior Publication Data

US 2013/0316118 A1 Nov. 28, 2013

Related U.S. Application Data

(60) Provisional application No. 61/651,159, filed on May 24, 2012.

(51) Int. Cl.
*E04C 5/07* (2006.01)
*E04G 23/02* (2006.01)

(52) U.S. Cl.
CPC ..... *E04C 5/07* (2013.01); *E04G 23/0218* (2013.01); *Y10T 29/49826* (2015.01); *Y10T 428/17* (2015.01)

(58) Field of Classification Search
CPC ..... E04C 5/07; E04C 5/00; B32B 5/24; B32B 27/00
USPC ..... 428/58
See application file for complete search history.

(56) References Cited

U.S. PATENT DOCUMENTS

| | | | | |
|---|---|---|---|---|
| 5,123,473 A | | 6/1992 | Henkenjohann | |
| 5,513,925 A | | 5/1996 | Dempsey et al. | |
| 5,635,263 A | * | 6/1997 | Saito | B29C 70/088 428/113 |

(Continued)

FOREIGN PATENT DOCUMENTS

| | | | | |
|---|---|---|---|---|
| GB | 2053086 A | | 2/1981 | |
| WO | WO-9517553 A1 | * | 6/1995 | E01C 11/165 |
| WO | WO-2012029966 A1 | * | 3/2012 | B62D 29/005 |

OTHER PUBLICATIONS

Advances in FRP Composites in Civil Engineering:Proceedings of the 5ht International Conference on FRP Composites in Civil Engineering (CICE 2010), Sep 27-29, 2010, Beijing, China, Lieping Ye, Peng Feng, Gingrui Yue, p. 146.*

(Continued)

*Primary Examiner* — Maria V Ewald
*Assistant Examiner* — Daniel P Dillon
(74) *Attorney, Agent, or Firm* — King & Schickli, PLLC

(57) ABSTRACT

A structural reinforcement includes a plurality of individual reinforcing elements. Each of the plurality of reinforcing elements includes a first end segment, a second end segment and an intermediate segment between the first and second end segments. A support engages the plurality of individual reinforcing elements along the intermediate segments and holds the elements in parallel.

6 Claims, 7 Drawing Sheets

(56) References Cited

U.S. PATENT DOCUMENTS 5,690,572 A * 11/1997 Belz ..... F16G 1/04 428/109
5,972,141 A 10/1999 Ellyin
6,183,835 B1 2/2001 Cho et al.
6,219,991 B1 4/2001 Salek-Nejad
6,468,613 B1 * 10/2002 Kitano ..... B32B 15/08 428/113
6,808,796 B1 * 10/2004 Miyao ..... B29C 70/202 428/113
7,987,639 B2 * 8/2011 Christopoulos ..... E04H 9/022 52/167.3
2002/0110680 A1 * 8/2002 Bank ..... E04C 5/07 428/297.4
2004/0067335 A1 4/2004 Li et al.
2005/0118369 A1 6/2005 Kennedy
2008/0127608 A1 6/2008 Williamson
2008/0251201 A1 * 10/2008 Sikkel ..... C08J 5/121 156/330
2009/0242119 A1 * 10/2009 Bech ..... B29C 66/1162 156/307.1
2010/0319171 A1 12/2010 Yu et al.
2011/0000606 A1 1/2011 Al-Emrani et al.
2012/0045606 A1 * 2/2012 Griess ..... B32B 3/06 428/57
2013/0157060 A1 * 6/2013 Komori ..... B62D 29/005 428/414

OTHER PUBLICATIONS

FRP Reinforcement for Concrete Structures, M.A. Erki and S.H. Rizkalla, A Sample of International Production, http://www4.ncsu.edu/~srizkal/TechPapers1989-90/FRPReinforcement_Erki.pdf.*
Advance in FRP Composites in Civil Engineering . . . (Year: 2010).*
FRP Reinforcements for Concrete Structures . . . (Year: 1993).*
Issam Harik; "High Performance Materials for Structural Repair"; Department of Civil Engineering, University of Kentucky; COM-MFUND-1196-RFP-010; Jun. 2011; pp. 1-16.

* cited by examiner

STRUCTURAL REINFORCEMENT, REINFORCED STRUCTURAL MEMBER AND RELATED METHOD

This utility patent application claims the benefit of priority in U.S. Provisional Patent Application Ser. No. 61/651,159 filed on May 24, 2012, the entirety of the disclosure of which is incorporated herein by reference.

TECHNICAL FIELD

This document relates generally to the fields of structural reinforcements, reinforced structural members and methods of reinforcing structural members.

BACKGROUND OF THE INVENTION

Structural members such as, for example, a beam, a joist, a column, a slab, a wall, a tank, a pole or a post, are well known in the art. Such members may be constructed from materials such as aluminium or steel, concrete, composite materials, such as fiber glass reinforced polymer material, wood or any other materials known in the art to be useful for the intended purpose. Often these structural members must be reinforced in order to reverse any gradual deterioration of strength properties that occur over time, or sudden loss of strength due to events such as impacts, earthquakes and other phenomena, so as to return the structural members to the required specifications. Similarly, the structural members may need to be reinforced in order to allow them to properly perform their function upon changes in the circumstance of their use such as floor joists or beams having to support newer, heavier equipment.

In any of these instances, it would be helpful to have a light weight, strong and easily installed structural reinforcement that is corrosion resistant and capable of providing a long service life in its environment of use. Such a structural reinforcement, simplified method of reinforcing a structural member and resulting reinforced structural member are disclosed in this document.

SUMMARY

In accordance with the purposes, benefits and advantages described herein, a structural reinforcement is provided. The structural reinforcement comprises a plurality of individual reinforcing elements. Each of the plurality of reinforcing elements includes a first end segment, a second end segment and an intermediate segment between the first and second end segments. The structural reinforcement further includes a support that engages the plurality of individual reinforcing elements along the intermediate segments thereof, holding the elements in parallel.

Gaps are provided between adjacent parallel reinforcing elements. Each reinforcing element has a width or diameter $W_1$ and each gap has a width $W_2$ where $W_1 \leq W_2$. In one useful embodiment the reinforcing elements are made from reinforced polymer. The material for reinforcing the polymer includes, but is not necessarily limited to, carbon fibers, glass fibers, aramid fibers, basalt fibers, steel fibers, carbon nanotubes and even mixtures thereof.

In one useful embodiment the reinforcing elements are laminates of multiple layers of reinforced composite material having a total thickness of between about, for example, 0.02" and 0.25". In another useful embodiment the reinforcing elements are rods having a diameter of between about 0.05" and 0.25". In one useful embodiment the first and second end segments have a length of between 1" and 12".

In one embodiment, the support for the plurality of individual reinforcing elements is made from an open mesh material. More specifically that material may be selected from a group consisting of glass fiber, textile fabric, plastic mesh, carbon fiber mesh, polymer fiber mesh, metallic fiber mesh and combinations thereof. In one embodiment the reinforcing elements are secured to the support by an adhesive. That adhesive may be selected from a group consisting of epoxy, polyester, vinylester, polyurethane, phenolics and mixtures thereof.

In accordance with an additional aspect, the support is flexible and the reinforcement is provided in a continuous roll with the reinforcing elements extending transversely across the continuous roll.

Still further, a reinforced structural member is provided. The reinforced structural member comprises a structural reinforcement secured to the structural member. The structural reinforcement includes a first panel having a first plurality of individual reinforcing elements wherein each of the first plurality of reinforcing elements includes a first end segment, a second end segment and a first intermediate segment between the first and second end segments. The structural reinforcement further includes a second panel having a second plurality of individual reinforcing elements wherein each of the second plurality of reinforcing elements includes a third end segment, a fourth end segment and a second intermediate segment between the third and fourth end segments. Still further, the structural reinforcement includes a finger joint between the first and second panels of said structural reinforcement. The finger joint includes the first end segments of the first plurality of individual reinforcing elements interdigitated with the third end segments of the second plurality of individual reinforcing elements.

The reinforced structural member further includes a first support engaging the first intermediate segments and holding the first plurality of reinforcing elements in parallel and a second support engaging the second intermediate segments and holding the second plurality of reinforcing elements in parallel. An adhesive secures the structural reinforcement to the structural member. The structural member may take substantially any form including but not limited to a beam, a joist, a column, a slab, a wall, a tank, a pole or even a post. In one particularly useful embodiment the first panel includes N number of reinforcing elements and the second panel includes N+1 number of reinforcing elements. When properly joined, the outermost reinforcing elements of the finger joint are both a part of the second panel.

Still further, a method of reinforcing a structural member is provided. That method comprises the step of cutting a first structural reinforcement panel from a roll of structural reinforcement material including a plurality of individual reinforcement elements extending transversely across the roll. The method also includes the step of fastening the cut structural reinforcement panel to the structural member to be reinforced. More specifically, the method includes cutting transversely across the roll in a gap provided between adjacent reinforcement elements. Still more specifically the method includes (a) cutting a second structural reinforcement panel from the roll of structural reinforcement material and (b) securing the first and second structural reinforcement panels to the structural member to be reinforced by (c) forming a finger joint between the first and second structural reinforcement panels wherein at least a first end segment of the plurality of individual reinforcement elements of the first structural reinforcement panel are interdigitated with at least a second end portion of the plurality of individual structural elements of the second structural reinforcement panel across a surface of the structural element. Further, the method includes adhering the first and second structural reinforcements to the structural member.

BRIEF DESCRIPTION OF THE DRAWINGS

The accompanying drawings incorporated herein and forming a part of the specification, illustrate several aspects of the present structural reinforcement and reinforced structural member and together with the description serve to explain certain principles thereof. In the drawings.

Reference will now be made in detail to the present preferred embodiments of the structural reinforcement, examples of which are illustrated in the accompanying drawings.

DETAILED DESCRIPTION

Figure 1:
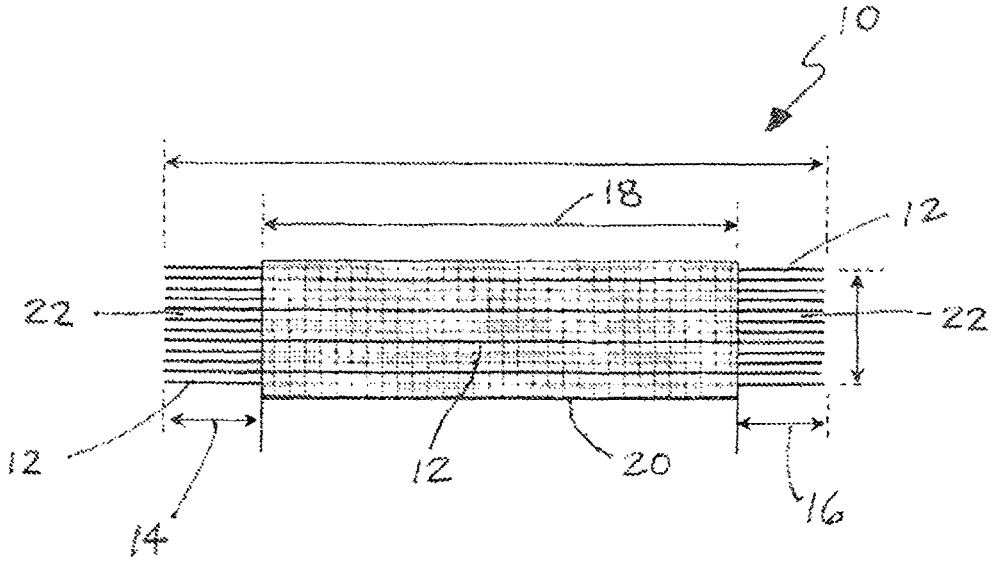
FIG. 1 is a schematical top plan view of a structural reinforcement.

Reference is now made to FIG. 1 schematically illustrating the structural reinforcement 10. The structural reinforcement 10 comprises a plurality of individual reinforcing elements 12. Each of the reinforcing elements 12 includes a first end segment 14, a second end segment 16 and an intermediate segment 18 between the first and second end segments. A support 20 engages the plurality of individual reinforcing elements 12 along the intermediate segments 18 and functions to hold the elements with a longitudinal axes thereof in parallel. Gaps 22 are provided between adjacent parallel reinforcing elements 12. In one embodiment, each reinforcing element has a width or diameter $W_1$ and each gap 22 has a width $W_2$ where $W_1 \leq W_2$. This is important in order to allow the formation of a proper finger joint between aligned structural reinforcement panels as will be described in greater detail below.

In one useful embodiment, the reinforcing elements 12 are made from a reinforced polymer. The reinforcement used in the reinforced polymer may be substantially any appropriate for the intended purpose including but not limited to carbon fibers, glass fibers, aramid fibers, basalt fibers, steel fibers, carbon nanotubes and mixtures thereof. In one possible embodiment the reinforcing elements 12 are layers of fiber reinforced polymer (FRP) or carbon fiber reinforced polymer (CFRP) laminated together to form strips. In one useful embodiment the strips have a thickness of between 0.02" and 0.25".

In another useful embodiment the reinforcing elements 12 are rods of FRP or CFRP having a diameter of between 0.05" and 0.25". In any of the embodiments the first and second end segments 14, 16 may have a length of between 1" and 12". In any of the embodiments the first and second end segments 14, 16 may have a length of between 1" and 6". In any of the embodiments the first and second end segments 14, 16 may have a length of between 3" and 6".

The support 20 used in the structural reinforcement 10 is typically made from an open mesh material providing a sufficiently open structure to allow good wetting and impregnation with an adhesive as will be described in greater detail below. The open mesh support 20 may be made from any appropriate material suitable for the intended purpose including but not limited to glass fiber, textile fabric, plastic mesh, carbon fiber mesh, polymer fiber mesh, metallic fiber mesh and combinations thereof.

In one embodiment the reinforcing elements 12 are secured to the support 20 by means of an adhesive. Substantially any adhesive suitable for the intended purpose may be utilized. The adhesive used must be compatible with the materials that form the reinforcing elements 12 and the support 20 as well as the material from which the structural member to be reinforced is made. Adhesives useful for the intended purpose include but are not limited to epoxy, polyester melts, vinylester melts, polyurethane melts, phenolics and mixtures thereof.

Figure 3:
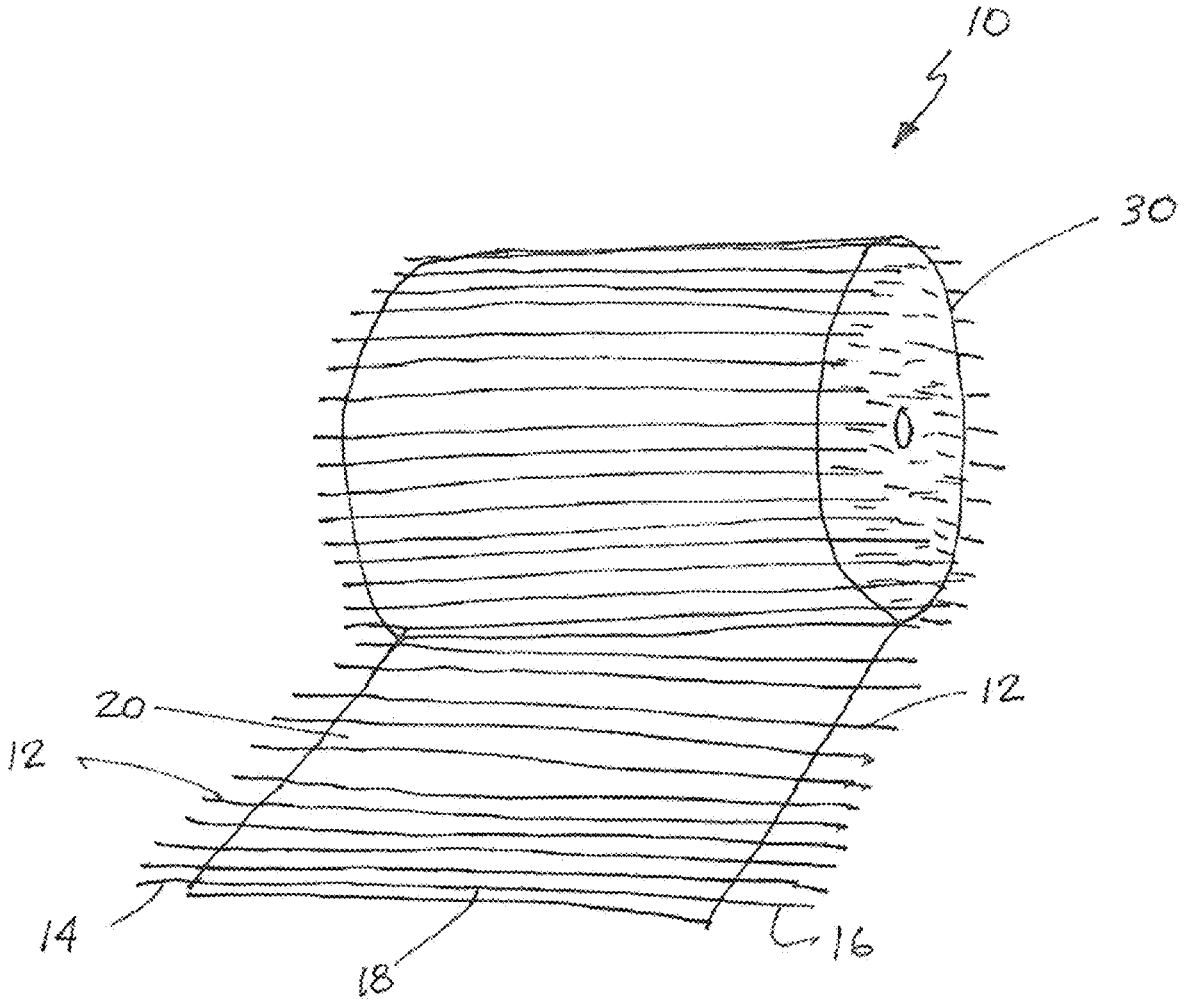
FIG. 3 is a schematical view of a structural reinforcement in the form of a continuous roll.

As illustrated in FIG. 3, the structural reinforcement 10 incorporates a flexible support 20 and is provided in a continuous roll 30 with the reinforcing elements 12 extending transversely across the continuous roll. As will be described in greater detail below such a roll 30 allows one to easily cut the structural reinforcement 10 to a desired width in order to reinforce substantially any structural member. For example, one could reinforce the lower surface of a 10" wide I-beam by cutting the structural reinforcement 10 to have a 10" width. Similarly, one could reinforce a 5" wide I-beam by cutting the structural reinforcement 10 to have a 5" width corresponding to that beam.

Figure 2:
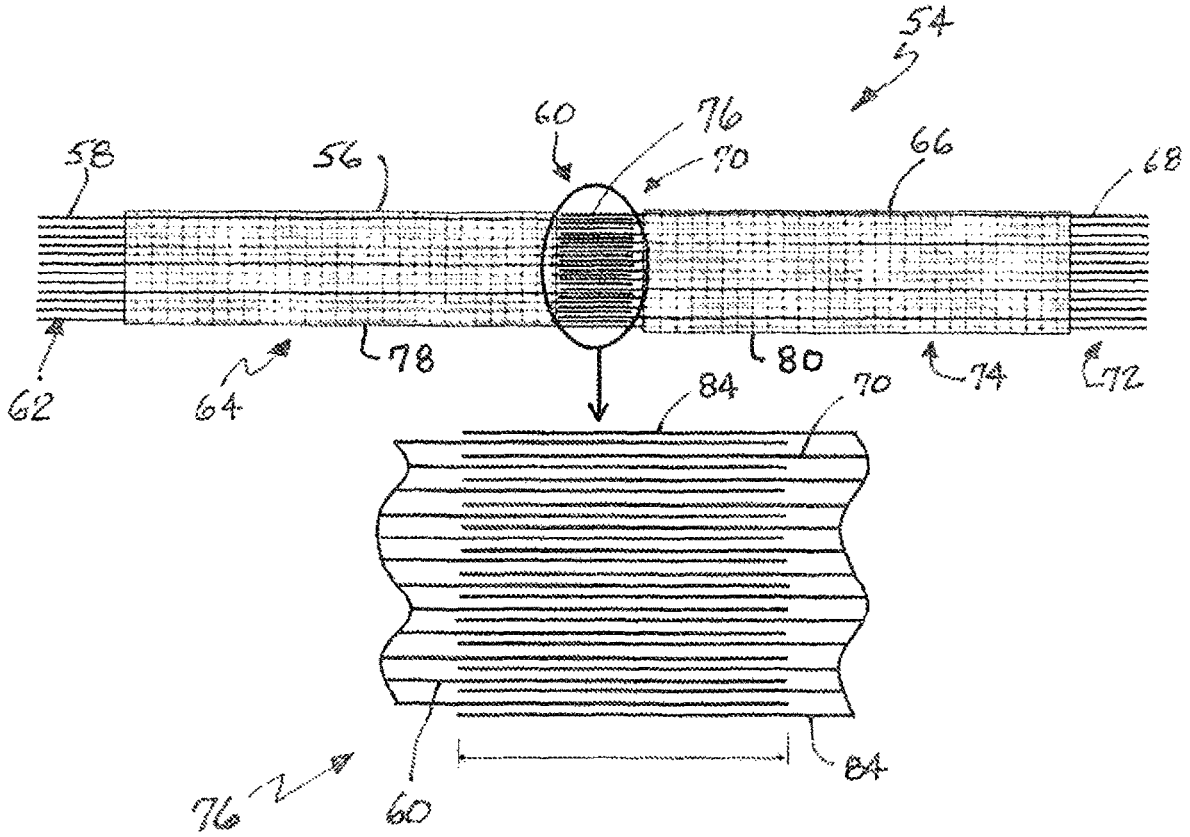
FIG. 2 is a schematical top plan view showing in detail the finger joint connecting two panels that are joined together to form the structural reinforcement.
Figure 4A:
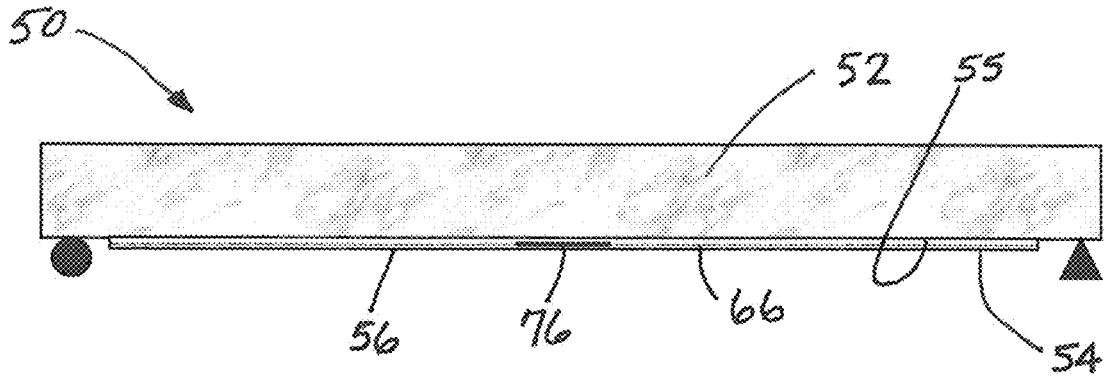
FIGS. 4*a*-4*c* are respective detailed, schematical side elevational, bottom plan and cross sectional views of a structural member reinforced with the structural reinforcement of FIG. 2.
Figure 4B:
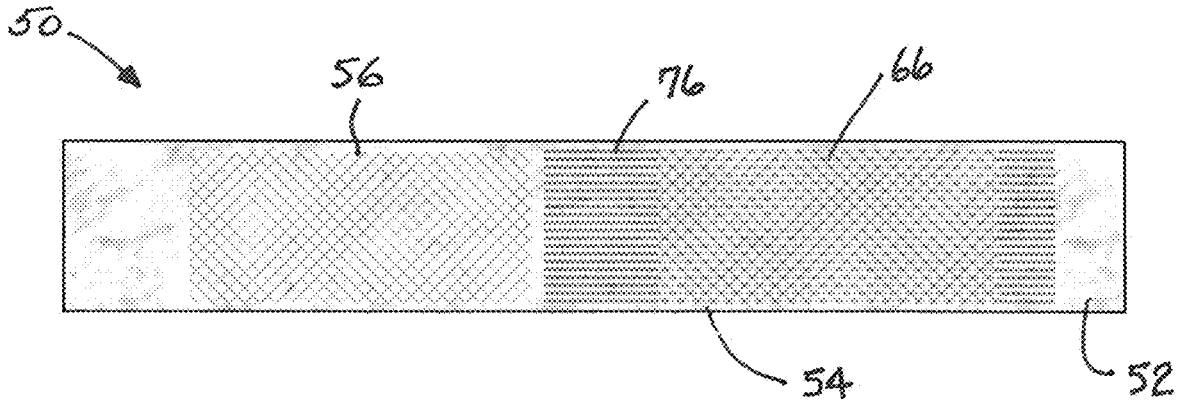
Figure 4C:
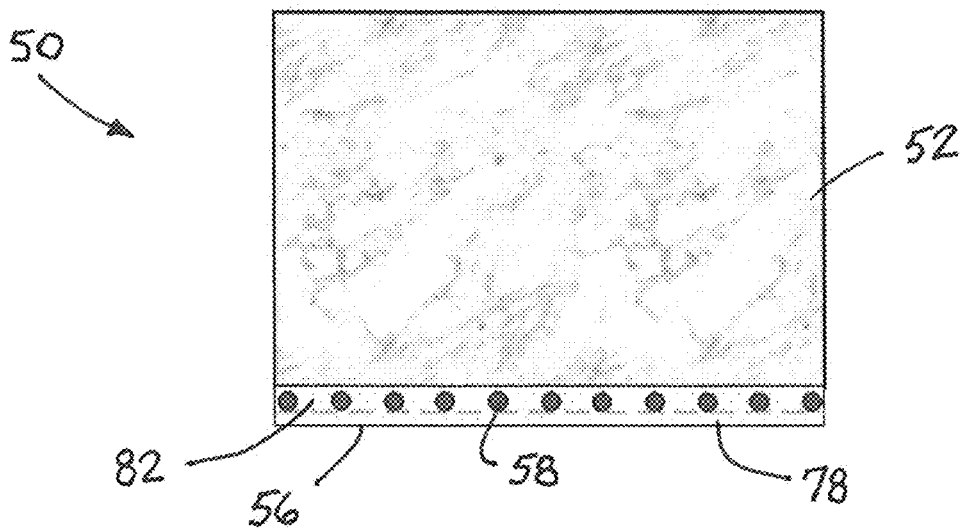

A reinforced structural member 50 is illustrated in FIGS. 4*a*-4*c*. The reinforced structural member 50 comprises a structural member 52 such as the illustrated concrete beam, and a structural reinforcement 54 secured to a surface 55 of the structural member. As illustrated in FIG. 2, the structural reinforcement 54 includes a first panel or section 56 having a first plurality of individual reinforcing elements 58. The reinforcing elements 58 include a first end segment 60, a second end segment 62 and a first intermediate segment 64 between the first and second end segments. The structural reinforcement 54 also includes a second panel or section 66 having a second plurality of individual reinforcing elements 68. Each of the second plurality reinforcing elements includes a third end segment 70, a fourth end segment 72 and a second intermediate segment 74 between the third and fourth end segments. A finger joint, generally designated by reference numeral 76, is provided between the first and second panels 56, 66 of the structural reinforcement 54. The finger joint 76 includes the first end segment 60 of the first plurality of individual reinforcing elements 58 interdigitated with the third end segments 70 of the second plurality of individual reinforcing elements 68. As clearly illustrated in FIG. 4*a*, the first panel or section 56 and the second panel or section 66 are coplanar when secured to the surface 55 of the structural member 52.

As further illustrated in FIGS. 2 and 4*c*, a first support 78 engages the first intermediate segments 64 and holds the first plurality of reinforcing elements 58 in parallel. A second support 80 engages the second intermediate segments 74 and holds the second plurality of reinforcing elements 68 in parallel. An adhesive 82 secures the structural reinforcement 54, including the first panel 56, second panel 66 and finger joint 76, to the structural member 52. As further illustrated in FIG. 2, the first panel 56 includes N number of reinforcing elements 58 while the second panel includes N+1 number of reinforcing elements 68. When the first end segments 60 are interdigitated with the third end segments 70 in order to form the finger joint 76, the outermost reinforcing elements 84 of the finger joint 76 are both a part of the second panel 66. This ensures all forces and stresses are centered and aligned along the parallel reinforcing elements 58, 68 of the structural reinforcement 54.

The method of reinforcing a structural member 52 will now be described. That method may be broadly described as comprising the steps of cutting a first structural reinforcement panel 56 from a roll 30 of structural reinforcement material where a plurality of individual reinforcement elements 58 extend transversely across the roll, and then fastening the cut structural reinforcement 52 to the structural member 50 to be reinforced. This includes cutting transversely across the roll 30 in a gap 22 provided between adjacent reinforcement elements 58. As the reinforcement elements 58 and gaps 22 typically have a width of between 0.02"-0.25", one is able to easily cut a structural reinforcement panel 56 to the necessary width to properly reinforce substantially any structural member 52.

In one embodiment the method further includes the steps of (a) cutting a second structural reinforcement panel 66 from the roll 30 of structural reinforcement material and (b) securing the first and second structural reinforcement panels 56, 66 to the structural member 52 to be reinforced by (c) forming a finger joint 76 between the first and second structural reinforcement panels. As described above, such a finger joint 76 includes at least a first end segment 60 of the plurality of individual reinforcement elements 58 of the first structural reinforcement panel 56 being interdigitated with at least a second end portion 70 of the plurality of individual structural elements 68 of the second structural reinforcement panel 66 across a surface of the structural element. This is followed by adhering the first and second structural reinforcement panels 56, 66 to the structural member 52. The adhesive utilized for adhering is provided at a sufficient depth to cover and fully encapsulate the entire structural reinforcement 54 including, but not limited to, the reinforcing elements 58, 68, the finger joint 76 and the open mesh supports 78, 80. This encapsulation functions to protect the entire reinforcement and the covered portions of the structural member 52 from the adverse and corrosive effects of the environment.

While the illustrated embodiment only shows two structural reinforcement panels 56, 66 connected together by a single finger joint 76 to run along and support the entire length of a structural member 52, it should be appreciated that additional reinforcements or sections may be joined to the panels 56, 66 through additional finger joints 76 to provide a reinforcement of substantially any desired length. In one particularly useful embodiment, the structural reinforcement or panels 56, 66 have a length of between about 2' and 8' and more particularly of about 4'. Such shorter reinforcements or panels may be easily handled by one or two people and quickly and efficiently installed on the surface of a structural member before an adhesive sets or begins to cure. Further, this can be done, for example, on the underside of a bridge while blocking only a single lane of traffic. In contrast, many prior art reinforcements are required to be a single piece spanning the entire length of the structural member. Where that reinforcement must span a beam of, for example, 50', a large number of individuals and additional equipment are required to complete the installation and an entire roadway must be blocked during the process. Reference will now be made to the following experimental examples which further illustrate the structural reinforcement 10, 54.

EXAMPLE 1

Manufacture of CFRP Rod Panels

CFRP Rod Panels (CRPs) are produced by cutting to length CFRP rods and creating panels that have multiple rods aligned in a parallel architecture, with uniform spacing larger than the rod diameter between rods, using a mesh type or other support backing. The CRPs can be used as an external structural reinforcement by bonding to a substrate using a structural epoxy. The CRPs can be brought together in a 'finger joint' at the panel ends to provide a continuous reinforcement that can be applied over a long span one panel at a time.

As noted above, the rods can be manufactured using carbon fiber, glass fiber, aramid fiber, ceramic fiber or other type of fiber. In one embodiment the CFRP rods presently utilized for the production of CRPs are GRAPHLITE® Carbon Rods manufactured by Diversified Structural Composites.

The diameter of the rods used to make CRPs can be changed depending on the strength required, available application area, and other considerations. The recommended diameter of the rods is 0.05 inch to 0.25 inch.

The length of the CRPs (length of the individual rods) can be changed depending on accessibility to reinforcing/strengthening location, rapid retrofit needs and other considerations. The recommended length of the panels for single workman application is between 2 ft. to 8 ft. The panels being produced now have a standard length of 4 ft.

The width of the panel, or how many rods are included in each panel, will depend on the strength requirement, the available application area and other considerations. The strength of the panels is specified per foot width, e.g. CRP 70 carries 70 kips/ft. of tensile force.

The requirement of the CRP backing is to keep the rods in place while being applied on to a structural substrate, and also allow the structural epoxy to completely wet and bond to the rods. The backing used presently is a self-adhesive fiberglass mesh, used in Exterior Insulation Finishing System (EIFS), with approximately 0.2"×0.2" (5 mm×5 mm) openings.

The backing is adhesively bonded to the rods, while leaving the ends of the rod panel free to create a 'finger joint' with an adjacent panel. The present CRPs are being bonded using commercially available spray on adhesives (e.g. Loctite 300, 3M Hi-Strength).

The overlap length between panels (finger joint) depends on the bond development length between the rods and the substrate. The recommended overlap length for the range of rod diameters specified earlier and for the application on steel or concrete substrate is 6 inches.

In order to have a balanced load transfer at the 'finger joints', it is recommended that each alternate panel have an additional rod, creating a more symmetric joint.

Testing of CFRP Rod Panels (CRPs)

Two different types of laboratory testing are carried out to evaluate the performance of CRPs. A study is carried out to evaluate the bond strength and development length of the CFRP rods used in the production of CRPs on a concrete substrate. This would provide the minimum length for the 'finger joint' used as the splicing for CRPs. Flexural test are carried out in four-point bending on small scale reinforced concrete (RC) beams to evaluate the performance of the CRPs in strengthening RC beams. The CFRP Rod Panel strengthened beam with the 'finger joint' splice is evaluated against an un-spliced rod panel strengthened beam as well as unstrengthened RC beams.

Double Strap Joint Tests

The objective of the double strap joint specimen test is to evaluate the bond length required to achieve full load transfer between the concrete substrate and CFRP rods. The test results are used to develop the finger joint length for continuity and load transfer between panels. Varying the bonded length on one side of the double strap joint specimen, the test evaluates the development length and ultimate joint load. The specimen dimensions are shown in FIG. 5.

Figure 5:
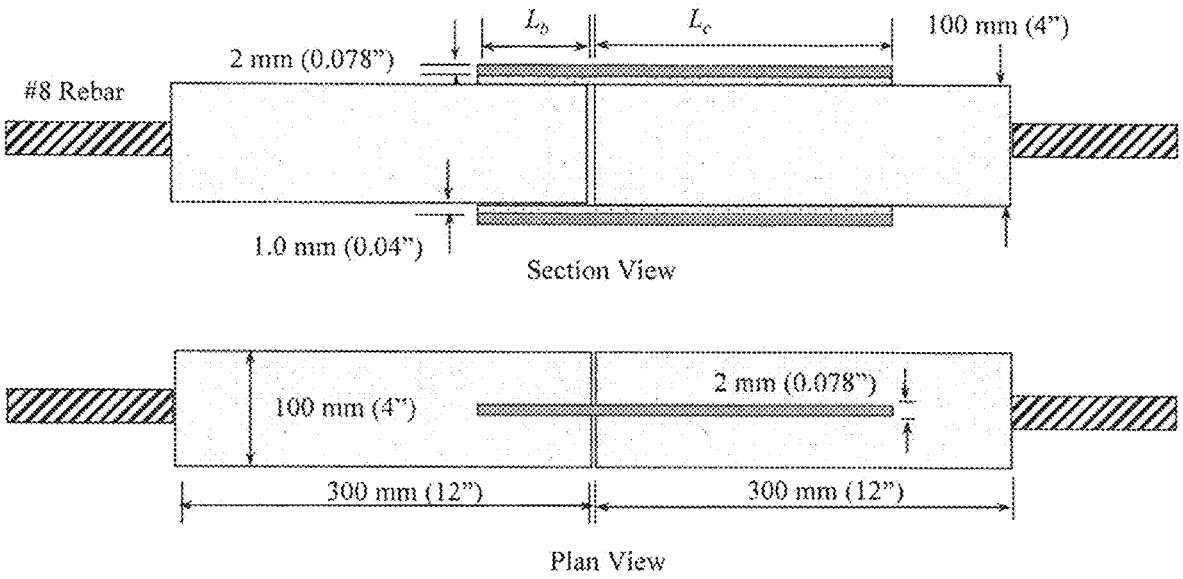
FIG. 5 comprises two schematical section and plan views showing specimens used in testing to evaluate the bond length required to achieve full load transfer between a concrete substrate and CFRP rods of the structural reinforcement.

CFRP rods were attached to both sides of the two concrete blocks, along the longitudinal centerline as shown in the layout in FIG. 5. The CFRP rods used in the tests were 0.078 in (2 mm) in diameter, with a tensile modulus of 19,500 ksi (134 GPa) and a design ultimate tensile strength of 320 ksi (2200 MPa). The bond lengths used in the test were: 0.5 in (12.5 mm), 1 in (25 mm), 1.5 in (37.5 mm), 2 in (50 mm), 3 in (75 mm), 4 in (100 mm), 5 in (125 mm), 6 in (150 mm) and 7 in (175 mm), while the control length was kept at 8 in (200 mm). Two test specimens were used for the 1 in (25 mm), 1.5 in (37.5 mm) and 7 in (175 mm) bond lengths.

The tests were conducted at the University of Kentucky Civil Engineering Department on a Satec universal testing machine. The specimens were placed in steel brackets to prevent misalignment and twisting during testing. The brackets were lubricated so that the friction between the concrete blocks and steel bracket would not add to the strength of the bond. The bonding agent used for this application was FX-778 epoxy resin. The specimens were allowed to cure for seven days before testing. All specimens were loaded to failure and each failure was documented. The predominant failure mode observed was the debonding between the epoxy and the concrete substrate. None of the test subjects ruptured the CFRP rods in tension.

Figure 6:
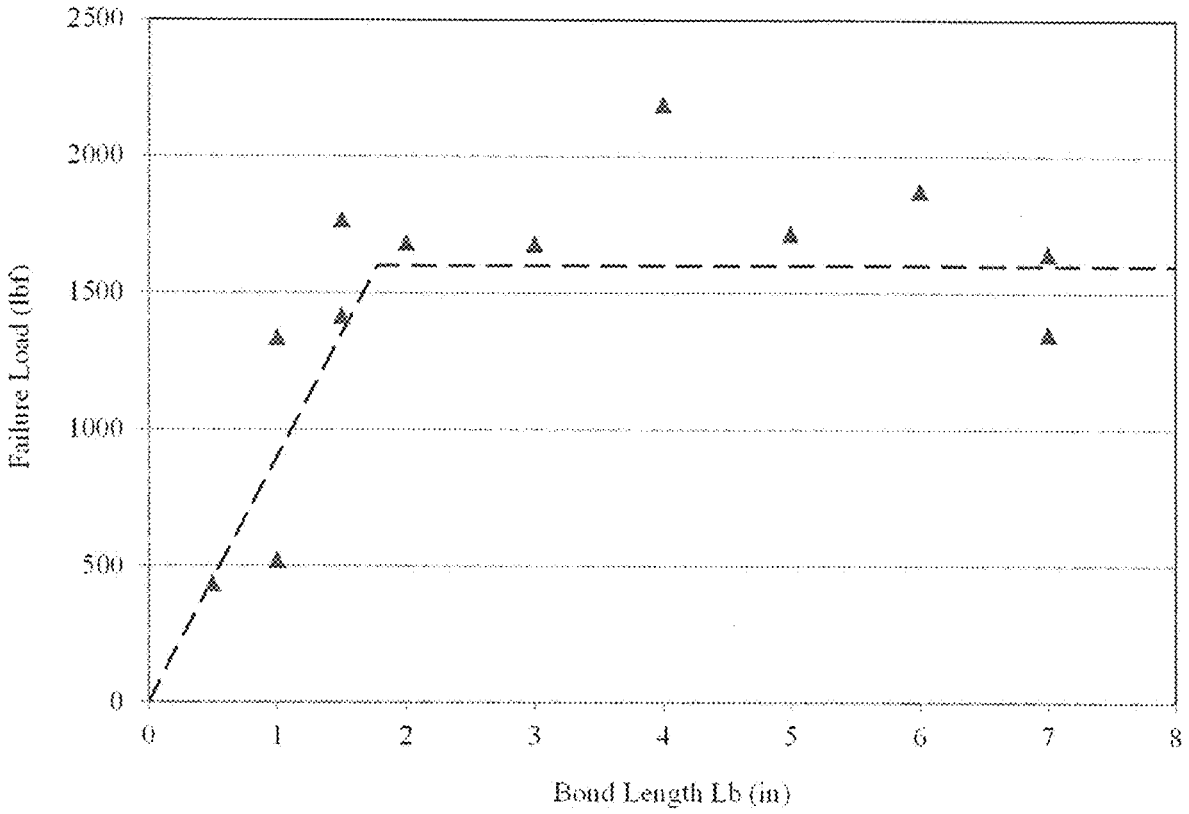
FIG. 6 is a plot of failure load to bond length.

The ultimate failure load per CFRP rod bond length is plotted against the tested bond lengths in FIG. 6. As seen in the test results, the development length for the CFRP rods is found to be approximately 1.8 in (46 mm), while the bond strength is approximately 1600 lbf (7.1 kN).

Concrete Beam Tests

Three Reinforced Concrete (RC) beam tests were carried out to evaluate the performance of the CFRP Rod Panels (CRPs) under flexural loading. All beams had a loaded span of 8 ft.(2.44 m), had a 6 in×6 in (150 mm×150 mm) cross section, and were reinforced in tension with two #3 reinforcing steel bars. Two different CRP configurations were tested and the strengthened beams evaluated against the non-strengthened control beam. The first beam was strengthened using continuous CFRP Rod Panel 7.5 ft. (2.3 m) long, while the second beam was strengthened using two 4 ft. (1.2 m) long CRPs with a 6 in. (150 mm) finger joint at mid-span. The same 0.078 in (2 mm) diameter CFRP rods were used for the fabrication of the rod panels and the same FX-778 epoxy resin used in the bond study was used to attach the rod panels to the concrete beams.

Figure 7:
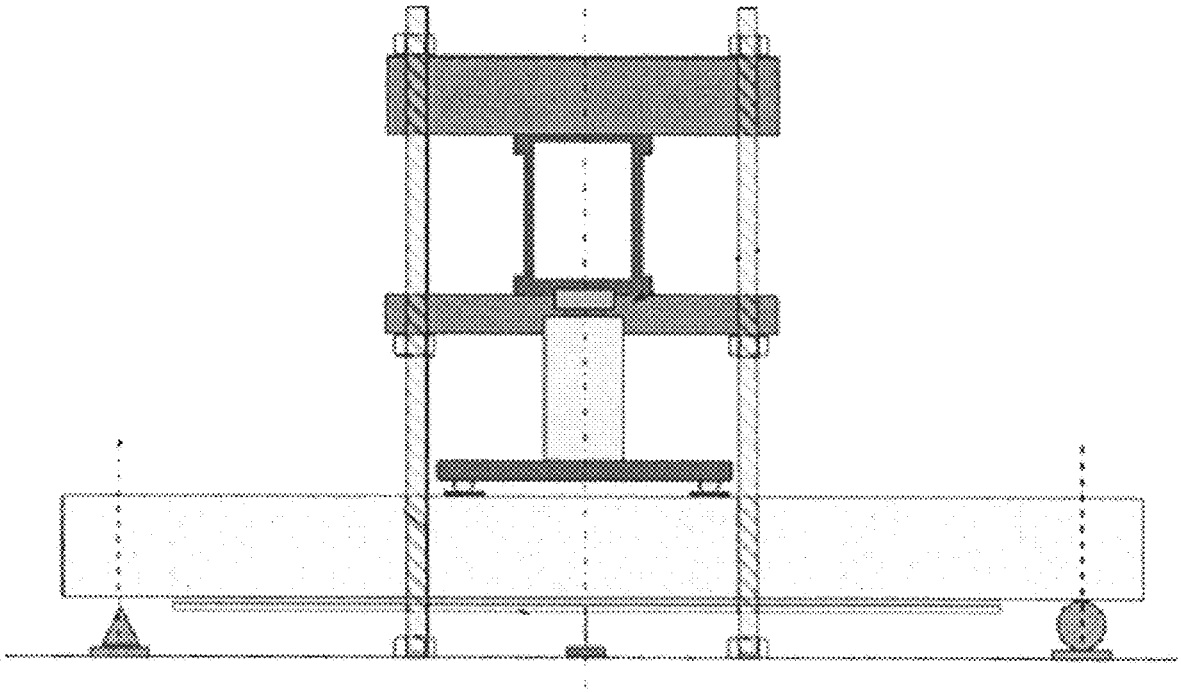
FIG. 7 is a schematical illustration of the beam test set up.

The beam test setup is shown in FIG. 7. Linear Variable Displacement Transducers (LVDTs) and cable extension displacement sensors were attached to mid-span, quarter-span and also the reaction frame to obtain displacement readings. Foil type strain gauges were attached, at mid span along the vertical face of the beams to evaluate the change in neutral axis, and along the bottom face of the beam.

Figure 8:
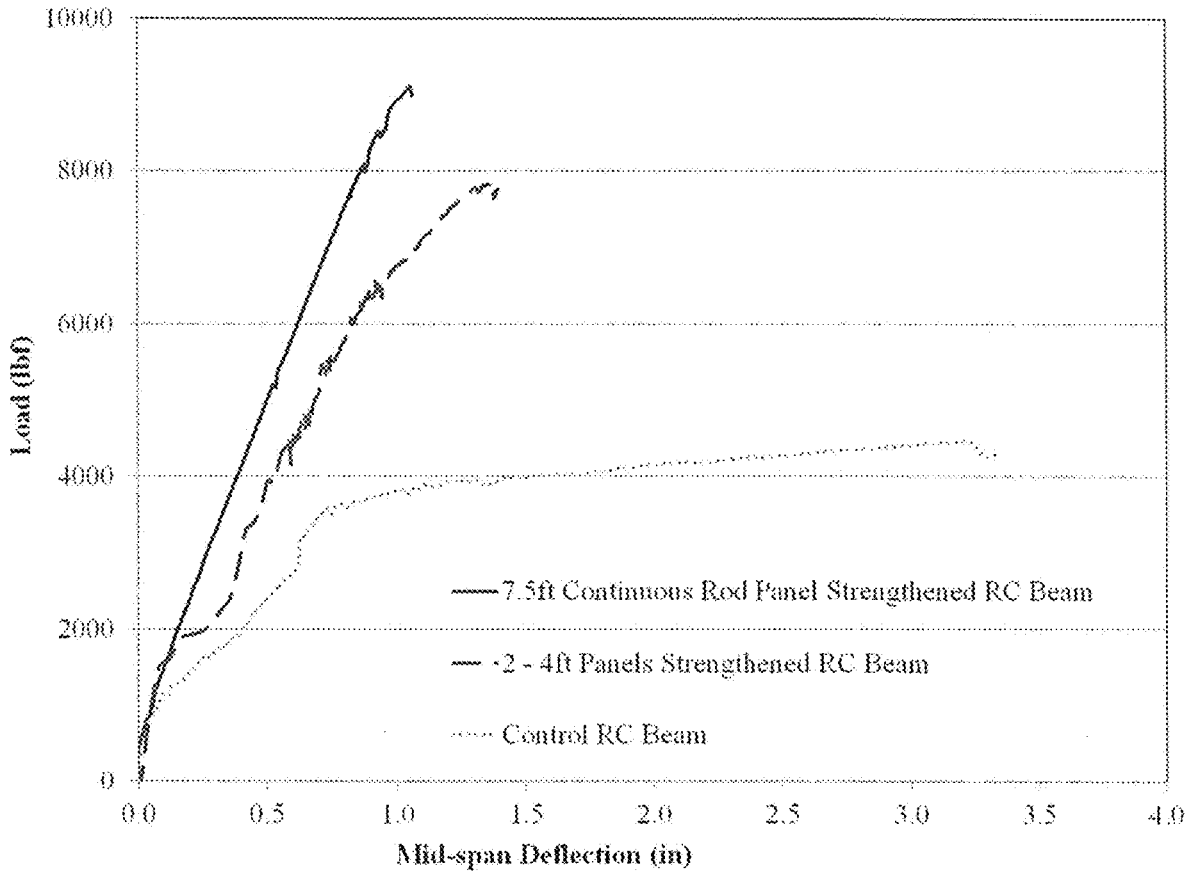
FIG. 8 is a plot of load to mid-span deflection.

The load vs. displacement results are shown in FIG. 8. The application of the CRPs is seen to approximately double the load carrying capacity of the RC beam. The load transfer between panels using the finger joint is seen to perform well when compared to the non-spliced continuous rod panel.

In summary, numerous benefits result from utilizing the structural reinforcement 10, 54 described in this document. One may easily and conveniently unroll and cut a reinforcement panel to any required width for any reinforcement application. Any number of panels may be joined together by finger joints to create a reinforcement of any desired length. Since the panels are relatively short, they may be easily positioned and installed by one or two workers before the adhesive sets at substantially any ambient temperature conditions. Advantageously, the finger joints between the panels insure the strength and integrity of the reinforcement. In fact, a multiple panel reinforcement is just as strong or stronger than a one piece reinforcement that would require additional equipment and a much larger number of workers to manipulate and install before the adhesive cures.

The foregoing has been presented for purposes of illustration and description. It is not intended to be exhaustive or to limit the embodiments to the precise form disclosed. Obvious modifications and variations are possible in light of the above teachings. For example, while the supports 78, 80 are illustrated on only one side of the reinforcing elements 58, 68, for certain applications it may be preferred to provide a support on both sides. All such modifications and variations are within the scope of the appended claims when interpreted in accordance with the breadth to which they are fairly, legally and equitably entitled.

What is claimed:

1. A reinforced structural member, comprising:

a structural member;

a structural reinforcement secured to said structural member, said structural reinforcement including:

(a) a first panel having (i) a first plurality of individual reinforcing rods, said first plurality of individual reinforcing rods comprising a first reinforced polymer with a first reinforcing material, wherein the first reinforcing material comprises at least one of carbon fibers, glass fibers, aramid fibers, basalt fibers, steel fibers, carbon nanotubes, or a mixture thereof, wherein each of said first plurality of reinforcing rods includes a first end segment, a second end segment and a first intermediate segment between said first and second end segments; and (ii) a first support engaging said first plurality of individual reinforcing rods only along the first intermediate segment;

(b) a second panel having (i) a second plurality of individual reinforcing rods, said second plurality of individual reinforcing rods comprising a second reinforced polymer with a second reinforcing material, wherein the second reinforcing material comprises at least one of carbon fibers, glass fibers, aramid fibers, basalt fibers, steel fibers, carbon nanotubes, or a mixture thereof, wherein each of said second plurality of reinforcing rods includes a third end segment, a fourth end segment and a second intermediate segment between said third and fourth end segments; and (ii) a second support engaging said second plurality of individual reinforcing rods only along the second intermediate segment; and (c) a finger joint between said first and second panels of said structural reinforcement, said finger joint including said first end segments of said first plurality of individual reinforcing rods interdigitated with said third end segments of said second plurality of individual reinforcing rods along a longitudinal axis of the reinforcing rods;

wherein said first panel, said second panel, and the finger joint are coplanar; and wherein each of the first panel and the second panel are connected to the structural member, and wherein the first panel does not contact the second panel.

2. The reinforced structural member of claim 1, wherein the first support holds said first plurality of reinforcing rods in parallel and wherein the second support holds said second plurality of reinforcing rods in parallel.

3. The reinforced structural member of claim 2, further including an adhesive for securing said structural reinforcement to said structural member.

4. The reinforced structural member of claim 3, wherein said structural member is a beam, a joist, a column, a slab, a wall, a tank, a pole or a post.

5. The reinforced structural member of claim 2, wherein said first panel includes N number of reinforcing rods and said second panel includes N+1 number of reinforcing rods and outermost reinforcing rods of said finger joint are both a part of said second panel.

6. A method of reinforcing a structural member, comprising:

cutting a first structural reinforcement panel from a roll of structural reinforcement material, wherein said structural reinforcement material comprises a plurality of individual reinforcement rods extending transversely across said roll, said plurality of individual reinforcement rods comprising a reinforced polymer with a rod reinforcing material, wherein the rod reinforcing material comprises at least one of carbon fibers, glass fibers, aramid fibers, basalt fibers, steel fibers, carbon nanotubes, or a mixture thereof, and wherein each of the plurality of individual reinforcing rods includes a first end segment, a second end segment, and an intermediate segment, and wherein said structural reinforcement material further comprises a support engaging said plurality of individual reinforcement rods only along the intermediate segment;

cutting a second structural reinforcement panel from said roll of structural reinforcement material; and securing said first and second structural reinforcement panels to said structural member to form a finger joint between said first and second structural reinforcement panels wherein the first end segment of the plurality of individual reinforcement rods of the first structural reinforcement panel is interdigitated with the second end portion of the plurality of individual structural rods of the second structural reinforcement panel across a surface of the structural member along a longitudinal axis of the plurality of individual reinforcement rods of the first structural reinforcement panel and the second structural reinforcement panel;

wherein the first structural reinforcement panel does not touch the second structural reinforcement panel.

* * * * *